US010263355B2

(12) United States Patent
Kitamura et al.

(10) Patent No.: US 10,263,355 B2
(45) Date of Patent: Apr. 16, 2019

(54) FEMALE TERMINAL HAVING A PROJECTION PROVIDED ON A LOWER EDGE OF A FRONT COVERING WALL TO A POSITION TO OVERLAP A BOTTOM WALL

(71) Applicant: Sumitomo Wiring Systems, Ltd., Yokkaichi, Mie (JP)

(72) Inventors: Keishi Kitamura, Mie (JP); Yoshihiro Mizutani, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/749,172

(22) PCT Filed: Jul. 20, 2016

(86) PCT No.: PCT/JP2016/071230
§ 371 (c)(1),
(2) Date: Jan. 31, 2018

(87) PCT Pub. No.: WO2017/022483
PCT Pub. Date: Feb. 9, 2017

(65) Prior Publication Data

US 2018/0226737 A1 Aug. 9, 2018

(30) Foreign Application Priority Data

Aug. 5, 2015 (JP) ..... 2015-154812

(51) Int. Cl.
*H01R 13/115* (2006.01)
*H01R 13/11* (2006.01)
*H01R 4/18* (2006.01)

(52) U.S. Cl.
CPC ..... *H01R 13/115* (2013.01); *H01R 4/185* (2013.01); *H01R 13/11* (2013.01)

(58) Field of Classification Search
CPC ... H01R 13/115; H01R 13/113; H01R 13/114; H01R 13/055; H01R 13/057; H01R 13/11; H01R 4/185
(Continued)

(56) References Cited

U.S. PATENT DOCUMENTS 5,685,746 A * 11/1997 Maejima ..... H01R 13/11 439/845
5,730,629 A * 3/1998 Samejima ..... H01R 13/113 29/874
(Continued)

FOREIGN PATENT DOCUMENTS

| | | |
|---|---|---|
| JP | 5-3146 | 1/1993 |
| JP | 8-321343 | 12/1996 |
| JP | 2015-2077 | 1/2015 |

OTHER PUBLICATIONS

International Search Report dated Sep. 17, 2016.

*Primary Examiner* — Harshad C Patel
(74) *Attorney, Agent, or Firm* — Gerald E. Hespos; Michael J. Porco; Matthew T. Hespos

(57) ABSTRACT

A terminal (10) includes a rectangular tube (21) with a bottom wall (21A), side walls (21B) rising from both sides of the bottom wall (21A) and a ceiling wall (21C) facing the bottom wall (21A). A contact (22) is inside the rectangular tube (21) and is folded from a front edge of the bottom wall (21A). Front covering walls (30) are in a front end part of the rectangular tube (21) at positions to cover a folded portion (22D) of the contact (22) from the front. Projections (31) on lower edges of the front covering walls (30) project to positions to overlap with the bottom wall (21A) in a front-rear direction. Coupling walls (32) are at positions to couple the front covering walls (30) and the side walls (21B). The
(Continued)

coupling walls (32) are flush with the side walls (21B) and located above lower ends of the projections (31).

5 Claims, 8 Drawing Sheets

(58) Field of Classification Search
USPC ..... 439/884, 851, 849, 850, 852, 854, 859, 439/352
See application file for complete search history.

(56) References Cited

U.S. PATENT DOCUMENTS

| | | | | |
|---|---|---|---|---|
| 5,788,542 | A | 8/1998 | Miwa | |
| 5,897,405 | A * | 4/1999 | Endo | H01R 13/11 439/852 |
| 5,989,078 | A * | 11/1999 | Chaillot | H01R 43/16 439/851 |
| 6,524,142 | B2 * | 2/2003 | Heimueller | H01R 13/113 439/843 |
| 7,252,562 | B1 * | 8/2007 | Chen | H01R 13/187 439/852 |
| 7,419,411 | B2 * | 9/2008 | Kaneko | H01R 13/113 439/851 |
| 8,043,130 | B2 * | 10/2011 | Casses | H01R 43/16 439/850 |
| 2005/0287878 | A1 * | 12/2005 | Urbaniak | H01R 4/185 439/856 |

* cited by examiner

FEMALE TERMINAL HAVING A PROJECTION PROVIDED ON A LOWER EDGE OF A FRONT COVERING WALL TO A POSITION TO OVERLAP A BOTTOM WALL

BACKGROUND

Field of the Invention

This specification relates to a terminal.

Description of the Related Art

Japanese Unexamined Utility Model Publication H05-53146 discloses a socket contact with a bottom wall, a first side wall and a second side wall standing upright on both sides of the bottom wall and a spring contact portion formed by bending each of a first extending portion and a second extending portion of the bottom wall inwardly into a U shape and overlaying the tip of the second extending portion on the first extending portion. Tabs are provided on the front ends of the first and second side walls and are aligned at a right angle to the respective side walls with the tips thereof butting against each other. The spring contact portion is surrounded from front by these tabs so that the spring contact portion is not damaged by an external force.

However, lower ends of parts extending rearward from the tabs (walls extending in an inserting direction of the socket contact into a connector cavity) are located substantially at the same height as the lower surface of the bottom wall. Thus, a wall surface of the connector cavity may be damaged in inserting the socket contact into the connector cavity. More particularly a sealing surface in a waterproof connector may be damaged.

SUMMARY

A terminal disclosed by this specification includes a rectangular tube composed of a bottom wall, two side walls rising from both side edges of the bottom wall and a ceiling wall facing the bottom wall. A contact portion is provided inside the rectangular tube and is folded from a front edge or a rear edge of the bottom wall. A front covering is provided in a front end part of the rectangular tube. The front covering wall is at a position to cover a folded portion of the contact from the front. A projection is provided on a lower edge of the front covering wall and projects to a position to overlap with the bottom wall in a front-rear direction. A coupling wall couples the front covering wall to the side wall and is flush with the side wall. The coupling wall is located above a lower end of the projection.

According to this configuration, even if the projection contacts an inner surface of a connector housing while inserting the terminal into the connector housing, the lower edge of the coupling wall does not contact the inner surface. Here, a state where the terminal is inserted while the projection is contacting the inner surface is the same as a state where a blade of a cutter knife is moved in a direction perpendicular to a cutting direction, and the inner surface is not damaged. On the other hand, a state where the terminal is inserted while the lower edge of the coupling wall is contacting the inner surface is the same as a state where the blade of the cutter knife is moved in the cutting direction, and the inner surface is damaged easily. Thus, the damage of the inner surface can be prevented by preventing the lower edge of the coupling wall from contacting the inner surface as described above.

A slit may be formed around the coupling wall. This configuration, it can be suppresses stress between the coupling wall and the side wall.

The lower edge of the front covering wall and a lower edge of the coupling wall may be located at the same height in a vertical direction. According to this configuration, a clearance equivalent to a height of the projection can be ensured between the lower edge of the coupling wall and the inner surface of the connector housing in a state where the projection is in contact with the inner surface of the connector housing.

The projection may extend obliquely rearward from the lower edge of the front covering wall. According to this configuration, the inner surface is less likely to be damaged when the terminal is inserted while the projection is contacting the inner surface of the connector housing.

According to the terminal disclosed by this specification, it is possible to prevent damage to an inner surface of a connector housing by preventing a lower edge of a coupling wall from contacting the inner surface.

DETAILED DESCRIPTION

Figure 1:
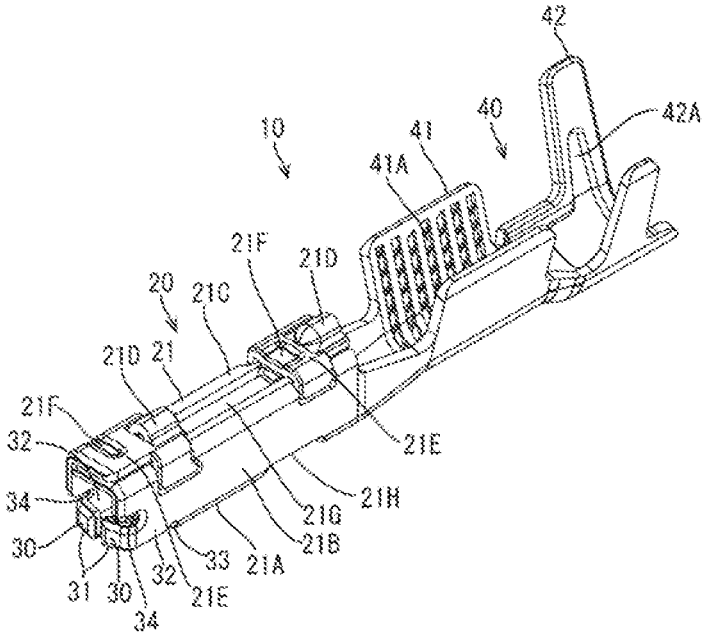
FIG. 1 is a perspective view of a terminal in a first embodiment.

A first embodiment is described with reference to FIGS. 1 to 7. A terminal 10 of this embodiment is a female terminal connectable to a male terminal 50 as shown in FIG. 6. The terminal 10 includes a terminal connecting portion 20 connectable to the male terminal 50 and a wire connecting portion 40 connectable to an unillustrated wire. The wire connecting portion 40 is composed of a wire barrel 41 to be crimped to a core of the wire and an insulation barrel 42 to be crimped to an insulation coating of the wire. The wire barrel 41 is disposed behind the terminal connecting portion 20 and the insulation barrel 42 is disposed behind the wire barrel 41.

Feather-shaped recesses 41A are formed in the inner surface of the wire barrel 41. On the other hand, a single recess 42A larger than the recesses 41A is formed in the inner surface of the insulation barrel 42. The recesses 41A, 42A improve connection reliability between the wire and the wire connecting portion 40.

Figure 2:
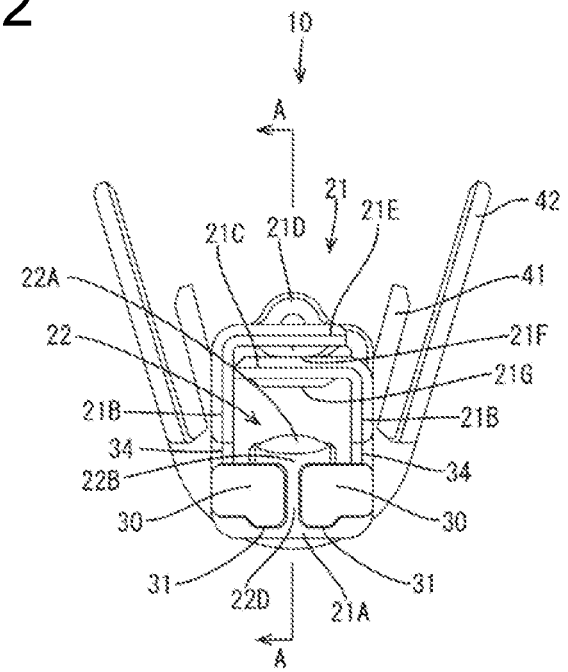
FIG. 2 is a front view of the terminal.
Figure 3:
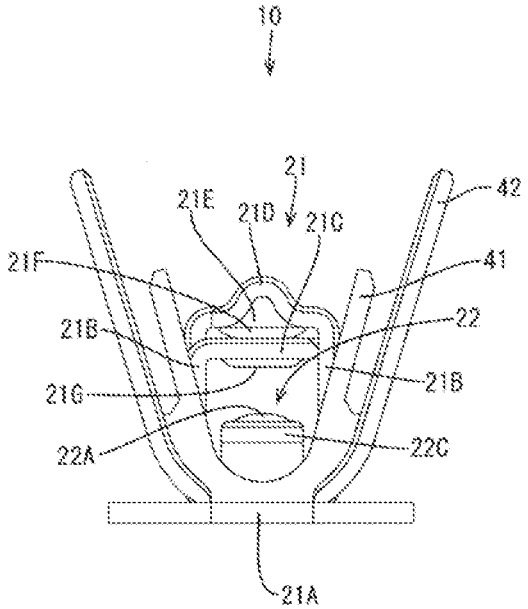
FIG. 3 is a back view of the terminal.
Figure 4:
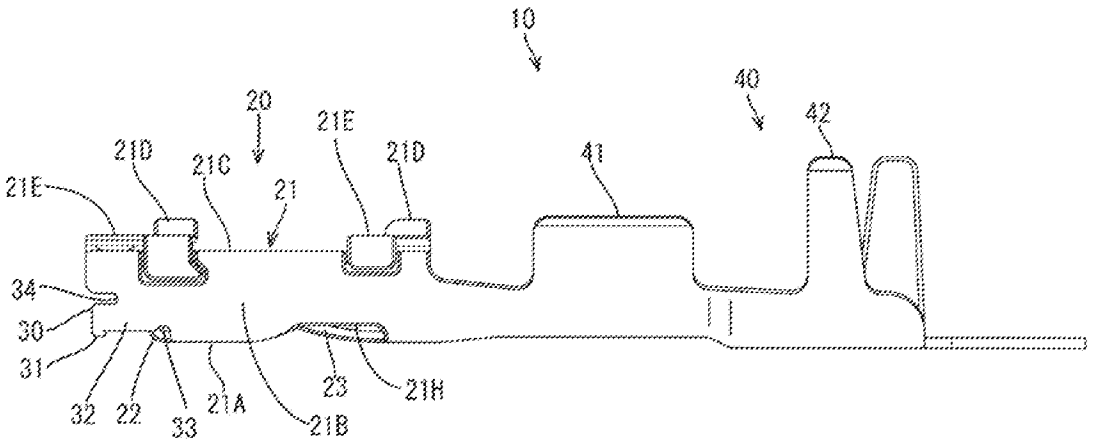
FIG. 4 is a side view of the terminal.

As shown in FIG. 2, the terminal connecting portion 20 includes a rectangular tube 21 with a bottom wall 21A, side walls 21B rising from both side edges of the bottom wall 21A and a ceiling wall 21C facing the bottom wall 21A. A contact portion 22 is provided inside the rectangular tube 21 and is folded from the front edge of the bottom wall 21A.

As shown in FIG. 1, front and rear projections 21D are provided on the upper surface of the ceiling wall 21C of the rectangular tube 21. An unillustrated locking lance is locked to the front projection 21D from behind to fix the terminal 10 in a connector housing 60 and a rearward movement of the terminal 10 is suppressed. Further, the rear projection 21D has a function of guiding the terminal 10 being inserted into the connector housing 60.

Figure 5:
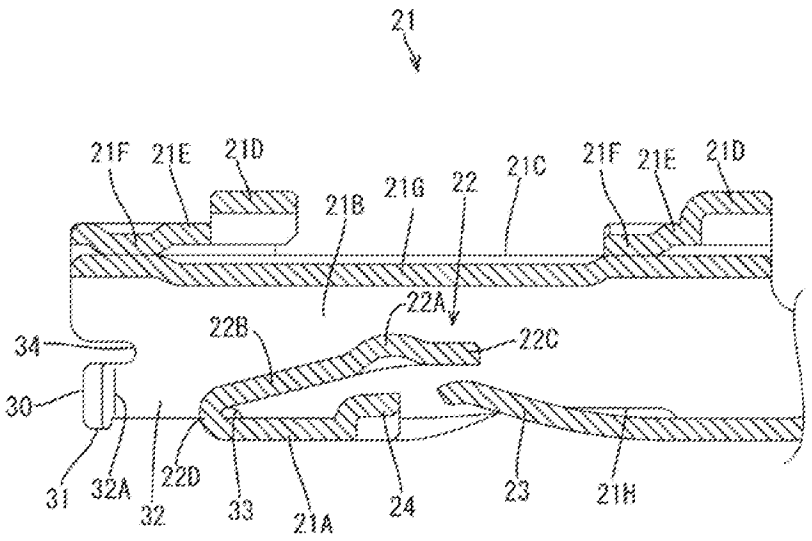
FIG. 5 is a section along A-A in FIG. 2.
Figure 6:
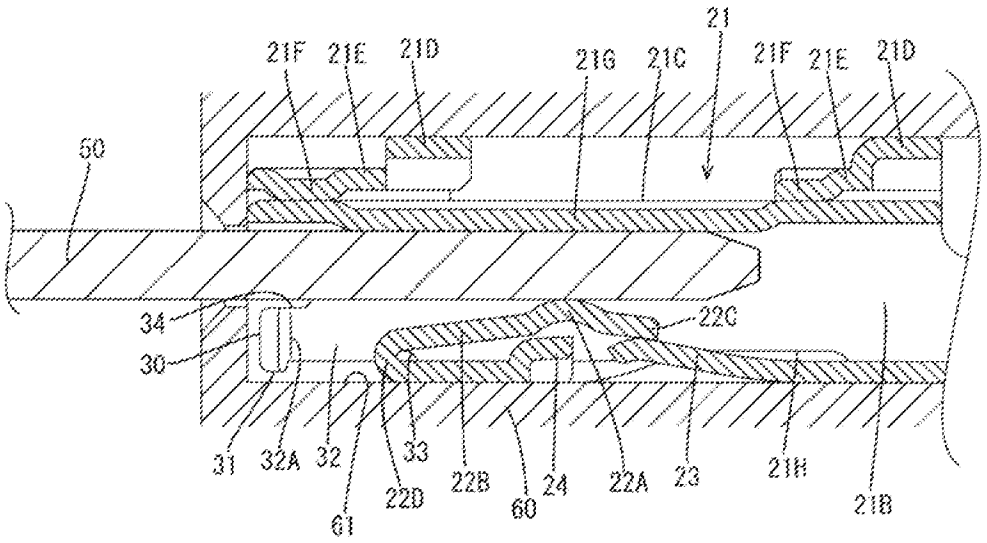
FIG. 6 is a section showing a state where the terminal is inserted in a connector housing and a mating terminal is connected to the terminal.

As shown in FIG. 5, the projection 21D is provided integrally with a pedestal 21E, and this pedestal 21E is provided with a downwardly recessed abutting portion 21F. This abutting portion 21F is in contact with the upper surface of the ceiling wall 21C. On the other hand, a downwardly recessed receiving portion 21G is provided between the front and rear abutting portions 21F on the upper surface of the ceiling wall 21C. This enhances the rigidity of the ceiling wall 21C, and the mating terminal 50 can be received by the receiving portion 21G when the mating terminal 50 and the terminal 10 are connected.

The contact portion 22 is cantilevered rearward from the front edge of the bottom wall 21A. The contact portion 22 includes a contact point 22A and parts 22B and 22C. The part 22B extends obliquely rearward from the front edge of the bottom wall 21A to the contact point 22A, and the part 22C extends rearward behind the contact point 22A parallel to the bottom wall 21A. The rear part 22C behind the contact point portion 22A is supported by an auxiliary spring 23. This auxiliary spring 23 is cantilevered forward from the rear edge of an opening 21H in the bottom wall 21A. Further, an excessive deflection preventing portion 24 is provided below the contact point 22A. This excessive deflection preventing portion 24 rises up from the front edge of the opening 21H.

Thus, the contact portion 22 is deflected with a small load until the contact portion 22 is pressed down and the rear part 22C contacts the auxiliary spring 23. After the rear part 22C contacts the auxiliary spring 23, the contact portion 22 is not deflected unless a large load is applied. As shown in FIG. 6, with the mating terminal 50 and the terminal 10 connected, the mating terminal 50 is sandwiched between the receiving portion 21G and the contact point 22A of the contact portion 22. A contact load at this time is generated by both the contact portion 22 and the auxiliary spring 23. Thus, contact resistance between the mating terminal 50 and the terminal 10 is low. Further, if the mating terminal 50 is inserted in an obliquely inclined posture, the contact point 22A contacts the excessive deflection preventing portion 24 to prevent excessive deflection of the contact portion 22.

As shown in FIG. 5, front covering walls 30 are provided in a front end part of the rectangular tube 21 and are disposed to cover a folded portion 22D of the contact portion 22 from the front. As shown in FIG. 2, two of the front covering walls 30 are provided in a bilaterally symmetrical arrangement. Projections 31 are provided on the lower edges of tip sides of the front covering walls 30 and project down to positions to overlap with the bottom wall 21A in a front-rear direction. As shown in FIG. 5, coupling walls 32 are provided at positions to couple the front covering walls 30 and the side walls 21B. These coupling walls 32 are flush with the side walls 21B and are located above the lower ends of the projections 31. Specifically, the two front covering walls 30 respectively project in from front edges 32A of the coupling walls 32, and a clearance formed between butting end parts of the respective front covering walls 30 is sufficiently smaller than the mating terminal 50. Further, the folded portion 22D of the contact 22 is located behind the front end part of the rectangular tube 21 by a length of the coupling walls 32. The length of the coupling walls 32 is substantially equal to a length of the pedestal 21E of the front projection 21D.

The projections 31 are provided in this way to prevent the coupling walls 32 from contacting an inner surface 61 of the connector housing 60 although the projections 31 contact the inner surface 61 of the connector housing 60 even if the front end of the terminal 10 is inclined down when inserting the terminal 10 into the connector housing 60. Particularly, in a waterproof connector, the inner surface 61 of the connector housing 60 needs to be a sealing surface, and the terminal 10 needs to be inserted straight into the connector housing 60 while close attention is paid not to damage the sealing surface. In that respect, in this embodiment, even if the terminal 10 is inclined, only the projections 31 contact the inner surface 61 of the connector housing 60 and the coupling walls 32 do not contact the inner surface 61 of the connector housing 60. Note that since the projections 31 are long in a lateral direction, there is no possibility of damaging the inner surface 61 of the connector housing 60.

Figure 7:
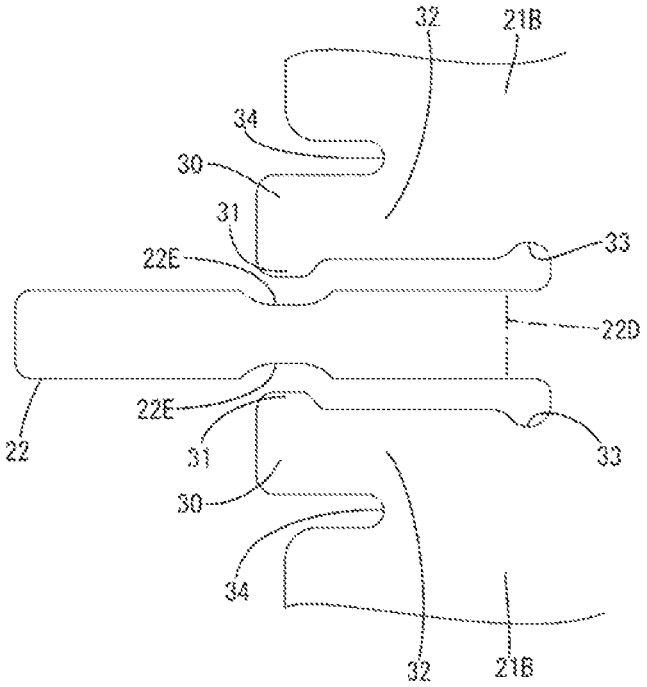
FIG. 7 is a view partly showing a developed state of the terminal.

Further, in a developed state of the terminal 10 shown in FIG. 7, cuts 22E are provided at positions of the contact portion 22 facing the projecting portions 31. These cuts 22E are formed by partially cutting off the contact 22 to avoid interference with the projections 31 and are at positions avoiding the folded portion 22D of the contact 22.

A rear slit 33 is provided at the rear end of the coupling wall 32. This rear slit 33 is located at a boundary between the coupling wall 32 and the side wall 21B in the front-rear direction. The rear slit 33 suppresses transmission of stress generated by the folded portion 22D of the contact portion 22 to the coupling wall 32. Further, even if stress is transmitted from the front covering wall 30 to the coupling wall 32, such as due to the contact of the mating terminal 50 with the front covering wall 30, the transmission of the stress from the coupling wall 32 to the contact 22 via the side wall 21B and the bottom wall 21A can be suppressed.

Similarly, an upper slit 34 is provided on the upper end of the coupling wall 32. This upper slit 34 is located at a boundary between the coupling wall 32 and the side wall 21B in a vertical direction. The upper slit 34 suppresses transmission of stress generated by the projection 21D being locked by the locking lance to the coupling wall 32.

As described above, even if the projections 31 contact the inner surface 61 of the connector housing 60 when inserting the terminal 10 into the connector housing 60, the lower edges of the coupling walls 32 do not contact the inner surface 61. Here, a state where the terminal 10 is inserted while the projections 31 are contacting the inner surface 61 is the same as a state where a blade of a cutter knife is moved in a direction perpendicular to a cutting direction, and the inner surface 61 is not damaged. On the other hand, a state where the terminal 10 is inserted while the lower edges of the coupling walls 32 are contacting the inner surface 61 is the same as a state where the blade of the cutter knife is moved in the cutting direction, and the inner surface 61 is damaged easily. Thus, the damage of the inner surface 61 can be prevented by preventing the lower edges of the coupling walls 32 from contacting the inner surface 61 as described above.

Slits (rear slits 33, upper slits 34) may be formed around the coupling walls 32. Thus, stress is not transferred between the coupling walls 32 and the side walls 21B.

Figure 8:
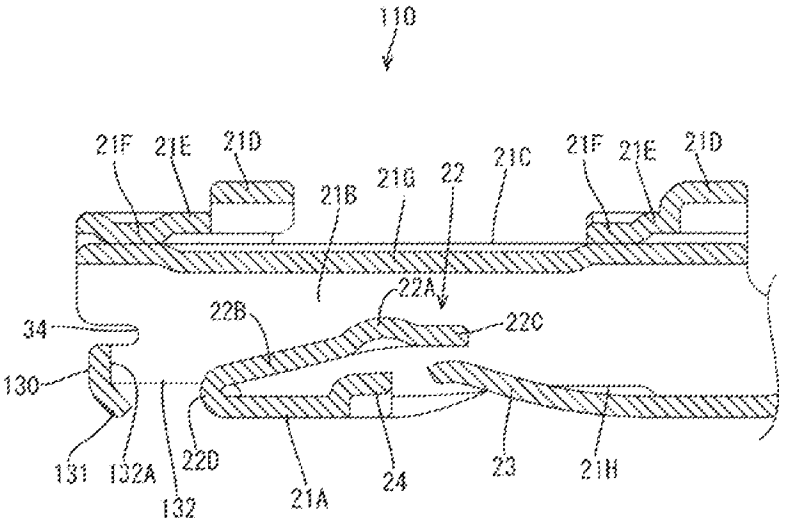
FIG. 8 is a section of a terminal in a second embodiment.

The lower edges of the front covering walls 30 and those of the coupling walls 32 may be located at the same height in the vertical direction. According to this configuration, a clearance equivalent to a height of the projections 31 can be ensured between the lower edges of the coupling walls 32 and the inner surface 61 of the connector housing 60 in a state where the projections 31 are in contact with the inner surface 61 of the connector housing 60. A second embodiment is described with reference to FIG. 8. A terminal 110 of this embodiment differs from the terminal 10 of the first embodiment in the configurations of the front covering walls 30, the coupling walls 32 and the projections 31 and the other configurations are the same. Thus, common components are denoted by the same reference signs as in the first embodiment and not described.

Projections 131 of this embodiment extend obliquely rearward from the lower edges of the front covering walls 130. The tips of the projections 131 are located behind front edges 132A of coupling walls 132. Further, lower end parts (contact portions with the inner surface 61 of the connector housing 60) of the projections 131 are rounded. The coupling walls 132 of this embodiment have a smaller vertical dimension than the coupling walls 32 of the first embodiment. Thus, slits corresponding to the rear slits 33 of the first embodiment are not provided in this embodiment.

According to this configuration, the inner surface 61 is less likely to be damaged when the terminal 110 is inserted while the projections 131 are contacting the inner surface 61 of the connector housing 60.

The invention is not limited to the above described and illustrated embodiments. For example, the following various modes are also included.

The contact 22 is folded from the front edge of the bottom wall 21A in the first and second embodiments. However, a contact may be folded from a rear edge of a bottom wall.

Although the rear slits 33 and the upper slits 34, 134 are provided around the coupling walls 32, 132 in the above first and second embodiments, slits may not necessarily be provided.

The lower edges of the front covering walls 30, 130 and those of the coupling walls 32, 132 are located at the same height in the vertical direction in the first and second embodiments. However, these lower edges may not be aligned at the same height.

The projection 31 is provided on the lower edge of the tip side of the front covering wall 30 in the first embodiment. However, a projection may be provided over the entire width on the lower edge of the front covering wall 30.

Although the lower end of the projection 131 is disposed at a position substantially aligned with the lower surface of the bottom wall 21A in the second embodiment, the lower end of a projection may be located slightly above the lower surface of the bottom wall 21A.

LIST OF REFERENCE SIGNS

10, 110 . . . terminal
21 . . . rectangular tube
21A . . . bottom wall
21B . . . side wall
21C . . . ceiling wall
22 . . . contact
30, 130 . . . front covering wall
31, 131 . . . projection
32, 132 . . . coupling wall
33 . . . rear slit
34, 134 . . . upper slit

The invention claimed is:

1. A terminal, comprising:

a rectangular tube composed of a bottom wall with first and second opposite sides, first and second side walls rising respectively from the first and second side of the bottom wall and a ceiling wall facing the bottom wall;

a contact provided inside the rectangular tube, the contact being folded from a front end or a rear end of the bottom wall;

a front covering wall provided in a front end part of the rectangular tube, the front covering wall being disposed at a position to cover a folded portion of the contact from the front;

a projection provided on a lower edge of the front covering wall, the projection projecting to a position to overlap with the bottom wall in a front-rear direction; and a coupling wall flush with the side wall, the coupling wall being provided at a position to couple the front covering wall and the side wall, the coupling wall being located above a lower end of the projection.

2. The terminal of claim 1, wherein a slit is formed around the coupling wall.

3. The terminal of claim 2, wherein a height of the lower edge of the front covering wall in a vertical direction and a height of a lower edge of the coupling wall in a vertical direction are the same.

4. The terminal of claim 1, wherein the projection extends obliquely rearward from the lower edge of the front covering wall.

5. The terminal of claim 1, wherein a height of the lower edge of the front covering wall in a vertical direction and a height of a lower edge of the coupling wall in a vertical direction are the same.

* * * * *